US009828871B2

(12) United States Patent
Poisson et al.

(10) Patent No.: US 9,828,871 B2
(45) Date of Patent: Nov. 28, 2017

(54) MAGNETIC CONTROL OF GUIDE VANES

(71) Applicant: Hamilton Sundstrand Corporation, Charlotte, NC (US)

(72) Inventors: Richard A. Poisson, Avon, CT (US); Joseph V. Mantese, Ellington, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 324 days.

(21) Appl. No.: 14/546,646

(22) Filed: Nov. 18, 2014

(65) Prior Publication Data

US 2016/0138415 A1 May 19, 2016

(51) Int. Cl.
*F01D 21/00* (2006.01)
*F01D 17/16* (2006.01)

(52) U.S. Cl.
CPC ..... *F01D 21/003* (2013.01); *F01D 17/162* (2013.01); *F01D 17/165* (2013.01)

(58) Field of Classification Search
CPC ..... F01D 17/02; F01D 17/22; F01D 17/24; F01D 17/162; F01D 17/165; F01D 21/003; F05D 2250/90; F02C 7/042
See application file for complete search history.

(56) References Cited

U.S. PATENT DOCUMENTS 4,275,371 A * 6/1981 Vogel ..... H01F 7/18 310/49.43
5,034,670 A * 7/1991 Tominaga ..... H01F 7/145 318/436
5,287,835 A * 2/1994 Fiorenza, II ..... F02D 9/02 123/352
5,380,152 A * 1/1995 Sikorski ..... B29D 99/0025 415/160
7,067,948 B2 * 6/2006 Yamaguchi ..... H02K 1/278 310/156.47
7,196,447 B2 * 3/2007 Tajima ..... B60L 15/025 310/156.53
7,259,551 B2 * 8/2007 Mock ..... G01D 5/2452 73/514.16
7,317,272 B2 * 1/2008 Shiga ..... H02K 29/08 310/156.12
8,172,517 B2 * 5/2012 Lighty ..... F01D 17/162 415/156
8,203,334 B2 * 6/2012 Baller ..... G01D 5/145 324/174
2008/0139883 A1 * 6/2008 Uchiyama ..... A61B 1/00158 600/117
2008/0284358 A1 * 11/2008 Ralea ..... B60T 8/1703 318/14
2013/0084179 A1 * 4/2013 Mantese ..... F01D 17/162 416/1

* cited by examiner

*Primary Examiner* — Woody Lee, Jr.
*Assistant Examiner* — Eric Zamora Alvarez
(74) *Attorney, Agent, or Firm* — Snell & Wilmer L.L.P.

(57) ABSTRACT

A system for controlling an angular position of a component of an aircraft includes a component having a shaft that includes at least one magnet. The system also includes a housing configured to receive the shaft and including at least one coil configured to generate a magnetic field based on a current through the at least one coil.

15 Claims, 6 Drawing Sheets

MAGNETIC CONTROL OF GUIDE VANES

FIELD

The present disclosure relates to gas turbine engines, and more particularly to control of guide vanes.

BACKGROUND

Gas turbine engines typically include a compressor section for compressing air. Air entering the compressor section may not enter at a constant angle. It is desirable to optimize the flow of air into the compressor section. In order to optimize the flow of air, the gas turbine engine may include guide vanes.

SUMMARY

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

What is described is a system for controlling an angular position of a component of an aircraft. The system includes a component having a shaft that includes at least one magnet. The system also includes a housing configured to receive the shaft and including at least one coil configured to generate a magnetic field based on a current through the at least one coil.

Also described is a system for controlling an angular position of a component of an aircraft. The system includes a component having a shaft having a longitudinal axis. The shaft includes a first row of magnets that includes a first plurality of magnets equally spaced about a circumference of the shaft. The system also includes a first power supply configured to generate a first current. The system also includes a housing configured to receive the shaft and including a first coil coupled to the first power supply. The first coil is configured to receive the first current and generate a first magnetic field based on the first current. The system also includes a controller coupled to the first power supply and configured to control the first current.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical, chemical and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1:
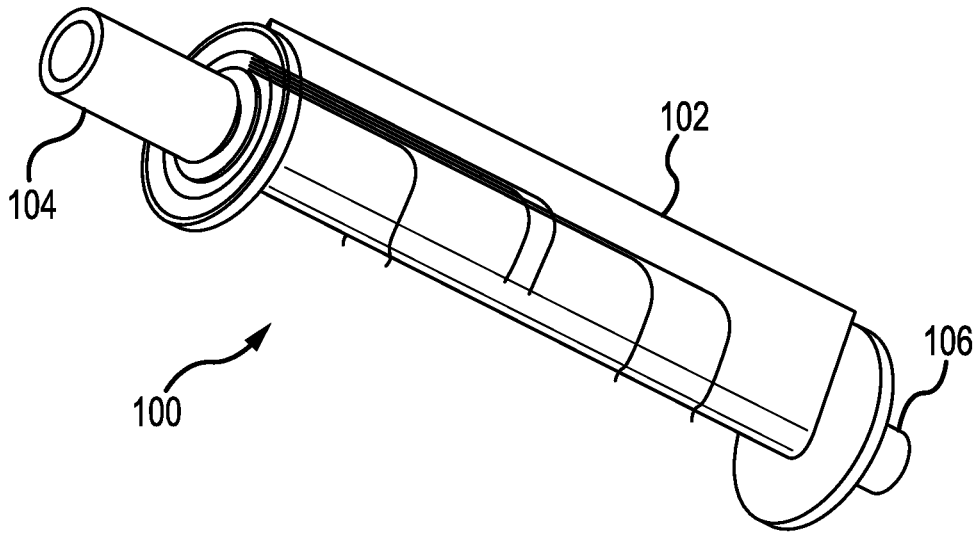
FIG. 1 illustrates a vane having a blade and a shaft, in accordance with various embodiments.

FIG. 1 illustrates a vane 100 in accordance with various embodiments. Vane 100 includes a shaft 104 and a shaft 106 positioned on opposite axial ends of vane 100. Vane 100 also includes a blade 102 positioned between shaft 104 and shaft 106. In various embodiments, vane 100 may include only one shaft and/or a shaft may be positioned axially inward from at least a portion of blade 102.

Vane 100 may be used to direct a flow of air. In various embodiments, vane 100 may be a variable vane within a compressor or a turbine of a turbine system, such as a guide vane within a compressor of a gas turbine engine. In various embodiments, vane 100 may be any other airfoil or component that is to be controlled in an angular fashion, such as an aileron, a flap, a fan blade, a position valve or the like.

Figure 3A:
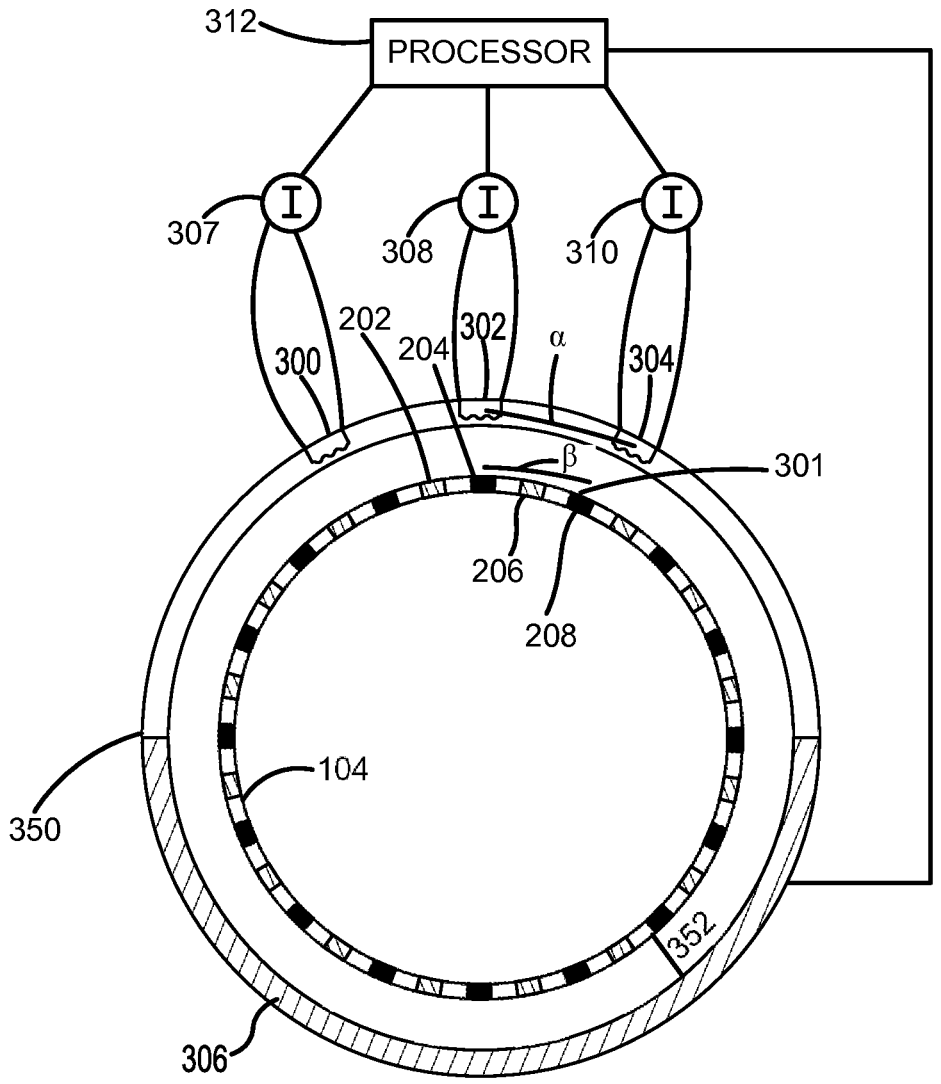
FIG. 3A illustrates the shaft of FIG. 2 positioned within a housing, in accordance with various embodiments.

Shaft 104 and/or shaft 106 may be positioned within a housing, such as housing 350, with brief reference to FIG. 3A. A compressor section of an aircraft may include one or more stages of vanes, such as vane 100. Each stage may include any number of vanes. Typically, each stage includes 48 vanes. Each vane may be rotated in order to optimize a flow of air through the vanes.

It is desirable to be able to determine the angular position of vane 100 as well as be able to control the angular position of vane 100. In order to determine and adjust the angular position, vane 100 may include magnets. Because shaft 104 and/or shaft 106 may be positioned in a housing, the housing may include position sensors and/or position control devices, such as coils connected to a power supply.

Figure 2:
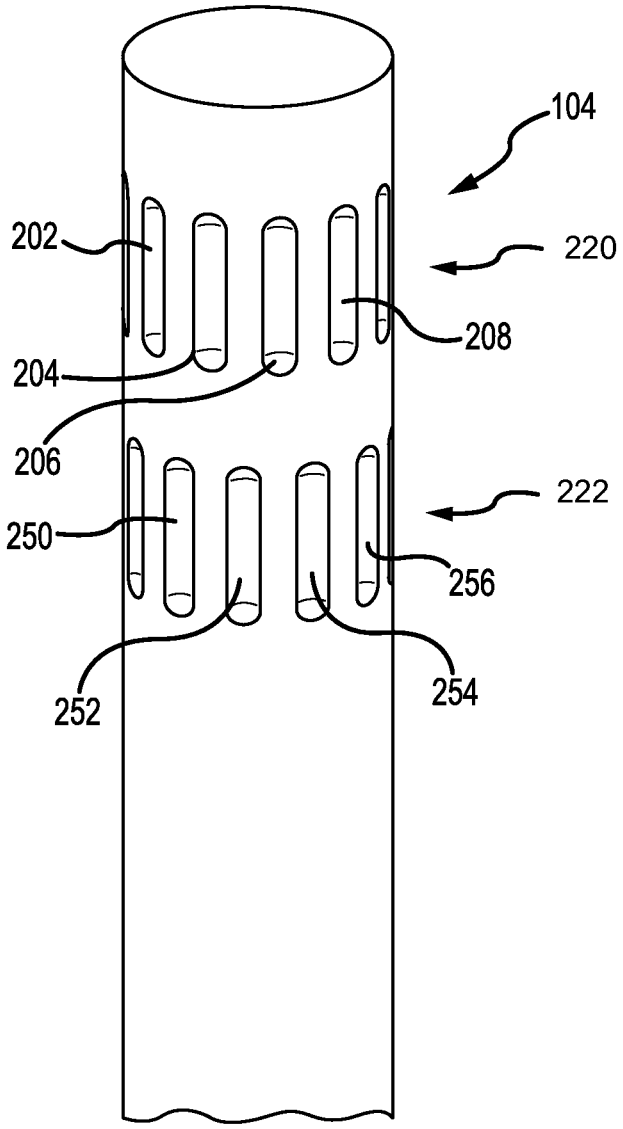
FIG. 2 illustrates an enlarged view of the shaft of FIG. 1, in accordance with various embodiments.

FIG. 2 illustrates an enlarged view of shaft 104. Shaft 104 may be cylindrical in shape, such that it includes a longitudinal axis and a circumference. Shaft 104 includes a row 220 and a row 222 of magnets positioned circumferentially around shaft 104. Each magnet in each row is spaced an equal distance from a circumferentially-adjacent magnet. Each row of magnets is positioned axially adjacent at least one other row of magnets. Shaft 104 may include any number of magnets and any number of rows of magnets. In FIG. 2, shaft 104 includes two rows of magnets. Each magnet and/or each row of magnets may have alternating polarities. For example, in row 220 magnet 202 may have a positive polarity, magnet 204 may have a negative polarity, magnet 206 may have a positive polarity and magnet 208 may have a negative polarity. In the row 222, magnet 250 may have a negative polarity, magnet 252 may have a positive polarity, magnet 254 may have a negative polarity and magnet 256 may have a positive polarity. In various embodiments, the position of magnets in each row may be shifted circumferentially so that no magnet in a row is aligned axially with a magnet in an adjacent row.

A housing (e.g., housing 350 of FIG. 3A) of shaft 104 may include a position sensor capable of detecting an angular position of shaft 104 based on the sensed position of the magnets. Similarly, the housing may include a magnetic control mechanism, such as electrically-charged coils.

With reference to FIG. 3A, shaft 104 is shown positioned within a housing 350. Housing 350 may have a tubular geometry, such that the interior of housing 350 may receive shaft 104. Housing 350 may include a longitudinal axis that is parallel to the axis of shaft 104. Housing 350 includes a position sensor 306, a coil 300, a coil 302 and a coil 304 positioned circumferentially about the axis of housing 350. The position sensor 306 may be connected to a controller, such as processor 312, positioned within housing 350 or positioned remote from housing 350.

Housing 350 may include any number of coils. In the embodiment illustrated in FIG. 3A, housing 350 includes three coils. Each coil 300, 302 and 304 may be connected to a power supply. For example, coil 300 is connected to power supply 307, coil 302 is connected to power supply 308 and coil 304 is connected to power supply 310. Each power supply may be connected to processor 312. In various embodiments, coil 300, coil 302 and coil 304 are each connected to a single power supply that may provide the same current to each coil or may provide a separate current to each coil.

Position sensor 306 may include a plurality of sensors capable of detecting magnetic fields. In this fashion, position sensor 306 may be capable of detecting an angular position of shaft 104 based on detection of the magnets of shaft 104. For example, a number of sensors may be positioned within position sensor 306 that are capable of detecting a magnetic force of the magnets of shaft 104. Position sensor 306 may be adapted to transmit the detected magnetic fields to processor 312. Processor 312 may be adapted to convert the detected magnetic fields into an angular position of shaft 104.

Each power supply may be adapted to supply an independent current to each coil. Power supply 307 may be adapted to provide a variable current to coil 300 as alternating current or direct current. The current may be variable in amount and direction. Coil 300 may generate a magnetic field based on the amount and direction of current supplied by power supply 307. The greater the current, the greater the magnetic field will be, and the direction of the current determines the polarity of the magnetic field. The magnetic field generated by coil 300 may attract or repel magnets positioned on shaft 104, based on the polarity of the nearest magnet(s) and the direction of current through coil 300. This attraction or repulsion of the magnets may create a torque upon shaft 104, possibly rotating shaft 104 within housing 350.

Just as one coil can generate a torque on shaft 104, multiple coils may increase the accuracy and total torque on shaft 104. In order for coil 300, coil 302 and coil 304 to create an optimal torque on shaft 104, the coils may be spaced from each other in a manner different from the spacing than the magnets. In FIG. 3A, coil 302 is spaced from coil 304 at an angular distance $\alpha$ (such as 10 degrees) and magnet 204 is spaced from magnet 208 by an angular distance $\beta$ (such as 7 degrees). For optimal control of shaft 104, angular distance $\alpha$ may be different than angular distance $\beta$ such that neither a nor 13 are integer multiples of each other. This results in an angle between any circumferentially adjacent magnets to not be an integer multiple of $\alpha$, nor a an integer multiple of the angle. In various embodiments, the distance between each coil may be different. This allows a particular amount and direction of current to be provided to each coil such that each coil can cause a specific torque on shaft 104 allowing a precise positioning of shaft 104. This also causes each coil to be in a different phase with the magnets, so that torque caused by each coil are added to the total torque on shaft 104.

A distance 352 may be present between shaft 104 and housing 350. Distance 352 may be selected based on a desired amount of torque on shaft 104. The greater distance 352 is the less torque will be applied to shaft 104 by the coils. Likewise, the smaller distance 352 is, the more torque will be applied to shaft 104 by the coils.

In various embodiments, position sensor 306 may encompass any area of housing 350. Similarly, coil 300, coil 302 and coil 304 may be positioned over any area of housing 350. As illustrated in FIG. 3A, position sensor 306 is positioned around half of the circumference of housing 350 and the coils are positioned radially opposite position sensor 306. With brief reference to FIG. 2, in various embodiments, position sensor 306 may be positioned entirely circumferentially around one row of magnets, such that it aligns with the row of magnets including magnet 250, magnet 252, magnet 254 and magnet 256, and coils may be positioned circumferentially around the other row of magnets, such that they are aligned with the row including magnet 202, magnet 204, magnet 206 and magnet 208. In this way, full angular control and sensing of shaft 104 may be achieved.

It is desirable for the coils to be positioned a certain distance from position sensor 306. Magnetic fields generated by the coils may cause position sensor 306 to detect a false measurement if the coils are positioned too close to position sensor 306. By positioning coils and position sensor 306 as illustrated in FIG. 3A, interference between the coils and position sensor 306 does not occur. Similarly, by positioning one row of coils circumferentially around housing 350 to align with one row of magnets and another row including position sensor 306 circumferentially to align with the other row of magnets, interference between the coils and the position sensor does not occur.

Each power supply may be connected to processor 312. Processor 312 may be adapted to determine an ideal direction and amount of current to be supplied by power supply 307, power supply 308 and power supply 310 that will cause shaft 104 to be positioned at a specified angle within housing 350. In FIG. 3A, processor 312 may instruct power supply 308 to generate a current through coil 302. This current may attract magnet 204 such that magnet 204 is aligned with coil 302. In various embodiments, current may flow through coil 300 and/or coil 304 to cause shaft 104 to remain in the position illustrated in FIG. 3A. This additional current through coil 300 and/or coil 304 may add to the torque applied to shaft 104 by coil 302. In FIG. 3A, magnet 208 is aligned with a point 301.

Figure 3B:
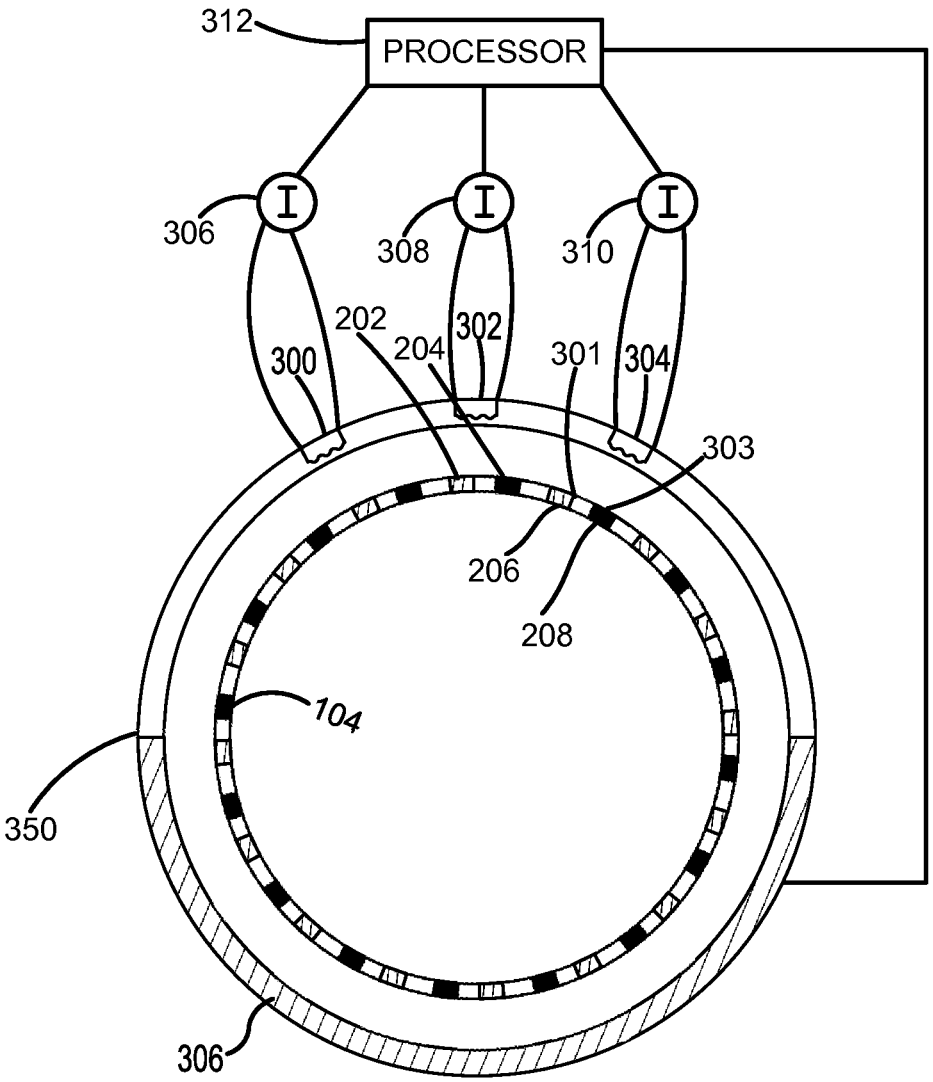
FIG. 3B illustrates the housing and shaft of FIG. 3A after a torque is applied to the shaft, in accordance with various embodiments.

FIG. 3B illustrates housing 350 and shaft 104 after a different torque is applied to shaft 104 than in FIG. 3A. In FIG. 3B, magnet 208 is now aligned with point 303. To rotate shaft 104 in this manner, processor 312 may cause power supply 310 to generate a current. This current through coil 304 may generate an electric field, thus attracting magnet 208. This attraction of magnet 208 may apply a torque to shaft 104 such that shaft 104 rotates at the angle between point 301 and point 303. In various embodiments, a current may flow through coil 300 and/or coil 302, applying additional torque on shaft 104.

By changing the amount of current and the direction of current flow within coil 300, coil 302 and coil 304, a torque may be applied to shaft 104 causing shaft 104 to rotate, as seen in FIGS. 3A and 3B. Different combinations of amount and direction of current may be applied to coil 300, coil 302 and coil 304 to cause shaft 104 to further rotate in either direction.

Figure 4:
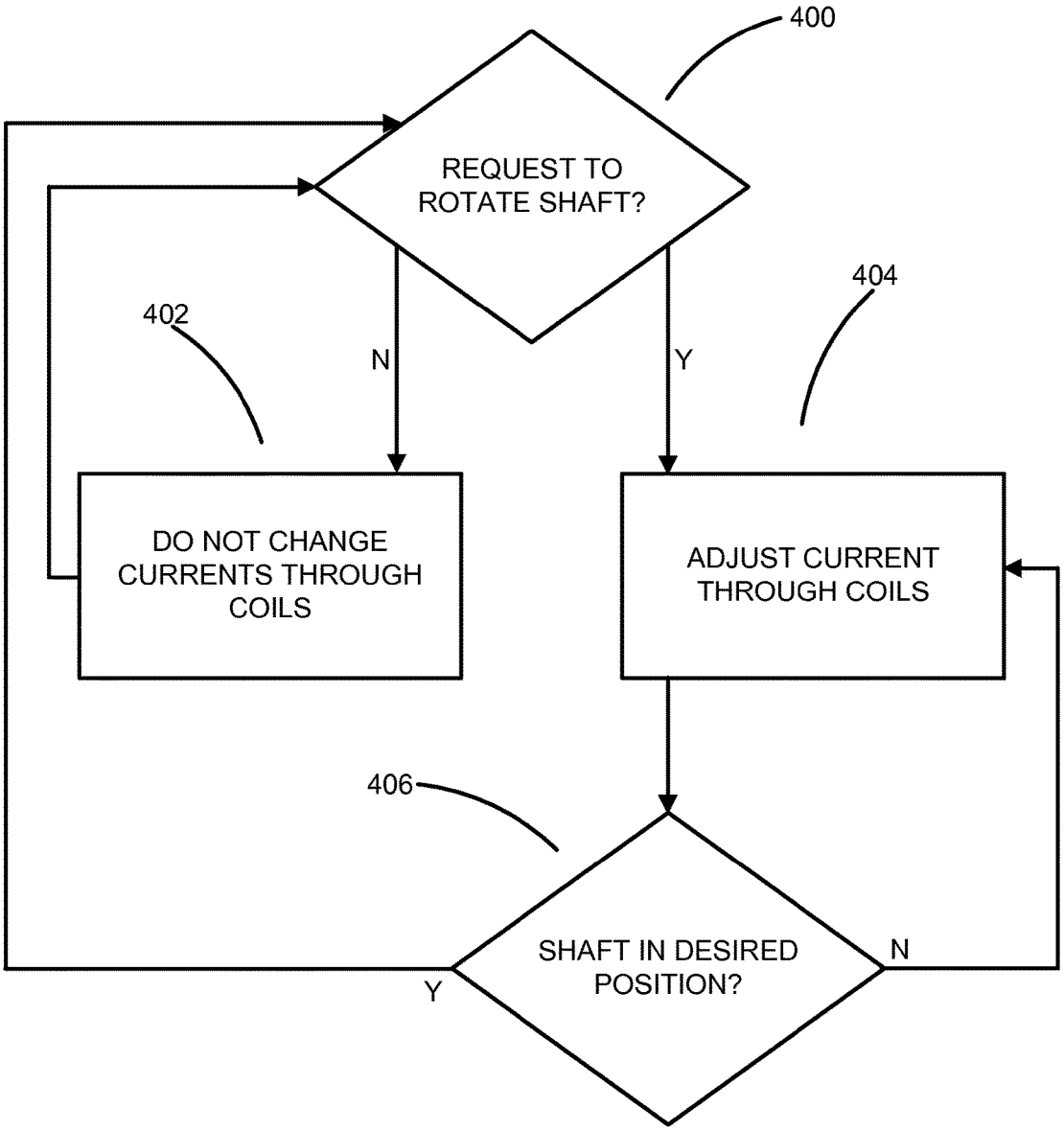
FIG. 4 is a flowchart illustrating a method for causing a shaft to be rotatably actuated within a housing, in accordance with various embodiments.

FIG. 4 is a flowchart illustrating a method for causing a shaft, such as shaft 104, to be rotatably actuated within a housing, such as housing 350. The method illustrated in FIG. 4 may be performed by a processor, such as processor 312. The processor may be connected to a non-transitory memory for storing machine readable instructions. The method illustrated in FIG. 4 may be stored in the memory or may be stored in the processor.

In block 400 it is determined whether a request has been received to rotate the shaft. This request may be received from a control system, an operator or determined by the processor. For example, the processor may determine a status of the flight, such as takeoff, airborne, landing, etc. and determine a desired position of shaft based on the flight status. In various embodiments, another control system may determine an optimal position of the shaft based on certain factors. Block 400 may also include a determination of whether the shaft is in a desired position. If the shaft is in a desired position, then no request to rotate the shaft will be determined. However, if the shaft is not in a desired position, that may be indicative of a request to rotate the shaft.

If no request has been made to rotate the shaft, the method proceeds to block 402. In block 402, the currents through each coil of the housing may be kept constant such that the shaft does not rotate. If a request has been received to rotate the shaft, then the method proceeds to block 404. In block 404, the current is adjusted through each coil. This adjustment may include changing the polarity through each coil or changing the amount of current through each coil. Block 404 may also include generating a current through a coil that previously had no current running through it or terminating current flow in a coil which previously had a current flow.

In block 406, it is determined whether the shaft is in a desired position. This may be determined based on readings from a position sensor, such as position sensor 306 of FIG. 3A. The processor or a remote system may compare the detected position of the shaft to a desired position of the shaft. If they match, then the process returns to block 400. If the desired shaft position is not the same as the current shaft position, then the method returns to block 404 where the current through each coil may be adjusted additionally.

Figure 5:
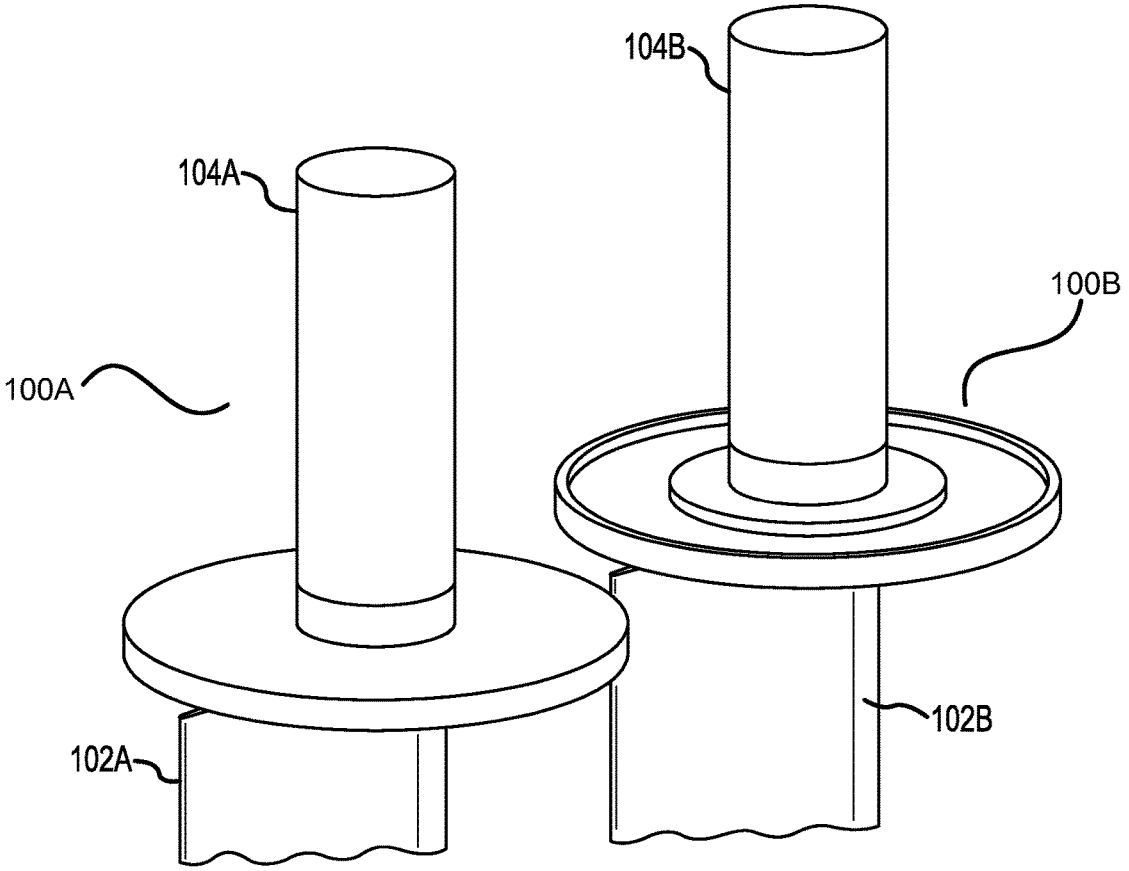
FIG. 5 illustrates two vanes which may be utilized in a portion of an aircraft, in accordance with various embodiments.

FIG. 5 illustrates two vanes which may be utilized in a portion of an aircraft. Vane 100A may be positioned adjacent vane 100B. Vane 100A may include a blade 102A and vane 100B may include a blade 102B. Vane 100A may include a shaft 104A and vane 100B may include a shaft 104B. Shaft 104A may be positioned within a housing and shaft 104B may be positioned in a housing other than the housing of shaft 104A. Shaft 104A and/or shaft 104B may include magnets. The housing of shaft 104A and/or the housing of shaft 104B may include coils. By pairing magnets of shaft 104A with coils of a housing, as well as magnets on shaft 104B and coils within another housing, vane 100A may be positioned independently of vane 100B. It may be desirable to have independent control of vane 100A and vane 100B.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system for controlling an angular position of a component of an aircraft comprising:

a component having a shaft that includes a first row of magnets that includes a first plurality of magnets equally spaced about a circumference of the shaft and a second row of magnets axially adjacent the first row of magnets and wherein the second row of magnets includes a second plurality of magnets equally spaced about the circumference of the shaft; and a housing configured to receive the shaft and including at least one coil and a magnetic position sensor, wherein the at least one coil is configured to generate a magnetic field based on a current through the at least one coil and wherein the magnetic position sensor is positioned circumferentially about the shaft and configured to detect an angular position of the shaft within the housing, wherein a first coil is positioned circumferentially around and aligned with the first row of magnets and the magnetic position sensor is positioned circumferentially around and aligned with the second row of magnets.

2. The system of claim 1, wherein the component is a variable vane in a turbine system.

3. The system of claim 1, further including a controller configured to control the angular position of the component by controlling the current through the at least one coil such that the magnetic field causes a torque on the shaft.

4. The system of claim 3, wherein the shaft has a longitudinal axis.

5. The system of claim 4, wherein the housing has a longitudinal axis and the at least one coil includes a first coil and a second coil circumferentially adjacent the first coil such that a different current may flow through the first coil than the second coil.

6. The system of claim 5, further comprising a first power supply coupled to the controller and the first coil and a second power supply coupled to the controller and the second coil, wherein the controller is configured to control the first power supply to generate the current through the at least one coil and the controller is configured to control the second power supply to generate the current through the second coil.

7. A system for controlling an angular position of a component of an aircraft, the system comprising:

a component having a shaft having a longitudinal axis, the shaft including a first row of magnets that includes a first plurality of magnets equally spaced about a circumference of the shaft and a second row of magnets axially adjacent the first row of magnets and wherein the second row of magnets includes a second plurality of magnets equally spaced about the circumference of the shaft;

a first power supply configured to generate a first current;

a second power supply configured to generate a second current;

a third power supply configured to generate a third current;

a housing configured to receive the shaft and including a first coil coupled to the first power supply and configured to receive the first current and generate a first magnetic field based on the first current, wherein the housing further includes a second coil coupled to the second power supply and configured to receive the second current and generate a second magnetic field based on the second current, wherein the housing further includes a third coil coupled to the third power supply and configured to receive the third current and generate a third magnetic field based on the third current, wherein the housing further includes a magnetic position sensor; and a controller coupled to the first power supply, the second power supply, and the third power supply, wherein the controller is configured to control the first current, the second current, and the third current, wherein the magnetic position sensor is coupled to the controller and is configured to detect the angular position of the shaft relative to the housing, wherein the first coil is positioned circumferentially around and aligned with the first row of magnets and the magnetic position sensor is positioned circumferentially around and aligned with the second row of magnets.

8. The system of claim 7, wherein the controller is configured to control the first power supply to generate a selectable level of negative and positive current.

9. The system of claim 7, wherein each circumferentially adjacent pair of magnets of the first plurality of magnets have opposite polarities.

10. The system of claim 7, wherein the housing further includes a magnetic position sensor coupled to the controller and configured to detect the angular position of the shaft relative to the housing.

11. The system of claim 10, wherein the housing has a longitudinal axis and the first coil is positioned circumferentially opposite the magnetic position sensor.

12. The system of claim 10, wherein the magnetic position sensor is positioned circumferentially about the longitudinal axis of the shaft of the component.

13. The system of claim 10, wherein the shaft is configured to rotate about the longitudinal axis, wherein the magnetic position sensor does not rotate with the shaft.

14. The system of claim 7, wherein an angular distance between adjacent magnets of the first plurality of magnets is different than an angular distance between the first coil and the second coil.

15. The system of claim 7, wherein each angular distance between each pair of circumferentially adjacent coils of the first coil, the second coil, and the third coil is different.

* * * * *